US006457204B1

(12) United States Patent
Bauböck et al.

(10) Patent No.: US 6,457,204 B1
(45) Date of Patent: Oct. 1, 2002

(54) DEVICE FOR DUST REMOVAL FROM A MOVING PAPER WEB

(75) Inventors: Jörg Bauböck; Adolf Gogg, both of Graz; Klaus Gissing, Judendorf-Strassengel, all of (AT)

(73) Assignee: Andritz AG, Graz (AT)

( * ) Notice: Subject to any disclaimer, the term of this patent is extended or adjusted under 35 U.S.C. 154(b) by 0 days.

(21) Appl. No.: 09/712,755

(22) Filed: Nov. 14, 2000

(30) Foreign Application Priority Data

Nov. 18, 1999 (AT) ..... 1950/99

(51) Int. Cl.[7] ..... A47L 5/38
(52) U.S. Cl. ..... 15/309.1; 15/306.1; 15/345
(58) Field of Search ..... 15/306.1, 309.1, 15/345

(56) References Cited

U.S. PATENT DOCUMENTS 5,291,628 A * 3/1994 Thayer ..... 15/306.1
5,457,847 A * 10/1995 Uzawa et al. ..... 15/306.1
5,490,300 A * 2/1996 Horn ..... 15/309.1
5,577,294 A * 11/1996 Pollock ..... 15/309.1
5,800,679 A * 9/1998 Lindström et al. ..... 15/345
5,836,044 A * 11/1998 Sinnett et al. ..... 15/309.1
5,878,462 A * 3/1999 Linden et al. ..... 15/309.1
5,964,956 A * 10/1999 Straub et al. ..... 15/309.1
6,148,831 A * 11/2000 Lindstrom et al. ..... 15/309.1

* cited by examiner

*Primary Examiner*—Theresa T. Snider
(74) *Attorney, Agent, or Firm*—Alix, Yale & Ristas, LLP

(57) ABSTRACT

A device for removing dust from a moving paper web, where the dust is carried in a boundary layer of air that runs with the web, includes a first separating box mounted across the web running direction. The first separating box has a collecting duct extending across the web running direction, a curved guide surface which guides the paper web, and apparatus for deflecting the dust-laden air boundary layer into the collecting duct.

13 Claims, 6 Drawing Sheets

DEVICE FOR DUST REMOVAL FROM A MOVING PAPER WEB

BACKGROUND OF THE INVENTION

The invention relates to a process for removing dust from a moving paper web, particularly a tissue web, where the air moving along with the web which has a high dust content is removed from the boundary layer. In addition, the invention relates to a device for implementing the process with a first separating box mounted across the sheet running direction.

In tissue-making, 1 to 2% of production, depending on the raw material, product, final dry content and chemical input, collects as dust in the creping sector. On the one hand, this dust has a negative effect on production and on the other, it creates a health and safety risk for the operating staff. Due to the trend towards softer tissue grades and the use of more mechanical pulp, the dust problem is increasing further. The dust comprises fine particles and fibre fragments which are removed from the paper web, primarily at the creping doctor. Some of the dust drops onto the floor of the machine room and the remainder is carried along with the air boundary layer on both sides of the paper web while it is transported from the creping doctor to the reel spool. Part of the dust remains on the surface of the paper web, which can cause difficulties further on in the finishing process.

SUMMARY OF THE INVENTION

The invention is aimed at creating a process and a device where the dust generated on a high-speed paper web, particularly a tissue web, is removed in such a way that the permissible limiting values for dust are not exceeded and, at the same time, the availability of the paper machine, particularly tissue machine, is increased.

The invention is thus characterized by the paper web running at a tangent onto and off the curved guide surface of a separating box, designed as a stabilizer, and by the air being deflected out of the boundary layer and removed by the separating box. Since the separating box is designed as a stabilizer, the web is guided over it exactly and the susceptibility to sheet breaks is substantially reduced because the web runs onto and off the curved guide surface at a tangent. This effect is further enhanced by the air being deflected out of the boundary layer, directed into the separating box and carried away from there. Thus, the vortices and overpressure otherwise common, and which also lead to sheet breaks, are avoided.

A favorable further development of the invention is characterized by the air being extracted from the boundary layer. This further reduces the risk of a sheet break due to overpressure.

A favorable configuration of the invention is characterized by the air being removed evenly over the sheet width. This measure also prevents overpressure occurring locally, which could also lead to sheet breaks, at any event with very thin paper grades.

An advantageous further development of the invention is characterized by the air being removed from the underside of the paper web in addition and then carried off, while the air removed from the underside of the paper web can be extracted by suction. By removing and then extracting the air from the underside, the dust adhering to the paper here is also removed and carried off. As a result it is possible to adhere to the required dust limiting values more easily.

An advantageous configuration of the invention is characterized by adding ambient air when the dust-filled air has been removed in order to avoid vortices from forming. In order to prevent any vortices forming while extracting sufficient air to remove the dust, and thus avoid any risk of a sheet break, dust-free ambient air is fed in at these points and the appropriate pressure thus re-established.

A favorable further development of the invention is characterized by the paper web being stabilized before the air is removed, where air carried along can be carried off by the stabilizer. This additional stabilizing of the paper web before the air is removed facilitates sheet guiding and also diminishes the risk of sheet breaks as a result. If air carried along is deflected by the stabilizer, some of the dust can be removed right away before the air separation process itself.

The invention also refers to a device for removing dust from a moving paper web, particularly a tissue web, with a first separating box mounted across the sheet running direction. It is characterized by the first separating box being designed as a stabilizer with a curved guide surface for the paper web and has a device for deflecting the air boundary layer into a collecting duct in the separating box. Since the separating box is shaped as a stabilizer with a curved guide surface, good sheet guiding is achieved and as a result, the risk of a sheet break is reduced. By carrying the air boundary layer into a collecting duct at the same time, the dust can be removed effectively from the high-speed paper web.

A further development of the invention is characterized by the cross-section of the collecting duct widening towards the drive side of the machine. This has the effect of carrying the air off evenly over the sheet width, thus preventing any vacuum or overpressure locally, which could lead to sheet breaks.

An advantageous configuration of the invention is characterized by a suction slot, which should preferably be adjustable, being provided on the side of the separating box on which the paper web runs onto its surface. The dust-filled air can be removed from this area through the suction slot, with the adjusting facility being used to either remove or extract whatever amount of dust is generated.

A favorable further development of the invention is characterized by the separating box being able to be opened along its entire width. This design provides an easy means of cleaning the box, which is particularly important with dust-filled air in a humid environment.

An advantageous configuration of the invention is characterized by a further separating box being provided on the underside of the paper web and onto which the paper web runs at a very narrow angle, preferably between 1 and 5 degrees, for example from 1 to 2 degrees. By placing a further separating box on the underside of the web it is possible to remove additional dust. Running the web onto the box at a very narrow angle is an easy method of achieving better sheet guiding, thus reducing sheet breaks on sharp edges.

An advantageous further development of the invention is characterized by the additional separating box having a deflection plate, preferably of swivelling design. This deflection plate can be used to guide the air directly into the separating box, while the swivelling design makes it possible to set the amount of air to be removed.

A favorable configuration of the invention is characterized by the bottom separating box being divided into at least two chambers. With this design the air upstream and downstream of the separating box can be carried off separately and the amount to be removed can also be set separately in order to guarantee stable sheet guiding without breaks.

A favorable further development of the invention is characterized by a stabilizer being provided upstream of the first separating box, which has the effect of spreading the paper web. The stabilizer can be of swivelling design. This additional stabilizer provides even more stable sheet guiding, while also generating additional air deflection and thus, reducing dust levels. With a swivelling design the ideal web tension is always guaranteed and if there is a sheet break, this stabilizer can be swung out of the way before the web is fed in again.

An advantageous further development of the invention is characterized by a funnel-shaped suction hood being provided at the doctor area on the drive side of the paper machine. With an extraction facility of this type it is also possible to remove the dust occurring during a sheet break and new web feed, thus reducing the dust loading.

An advantageous configuration of the invention is characterized by a further separating box being provided on the top side of the paper web. By including this box it is also possible to remove any residual dust adhering to the top side of the paper web before it is wound onto the reel spool.

DETAILED DESCRIPTION OF THE PREFERRED EMBODIMENT

Figure 1:
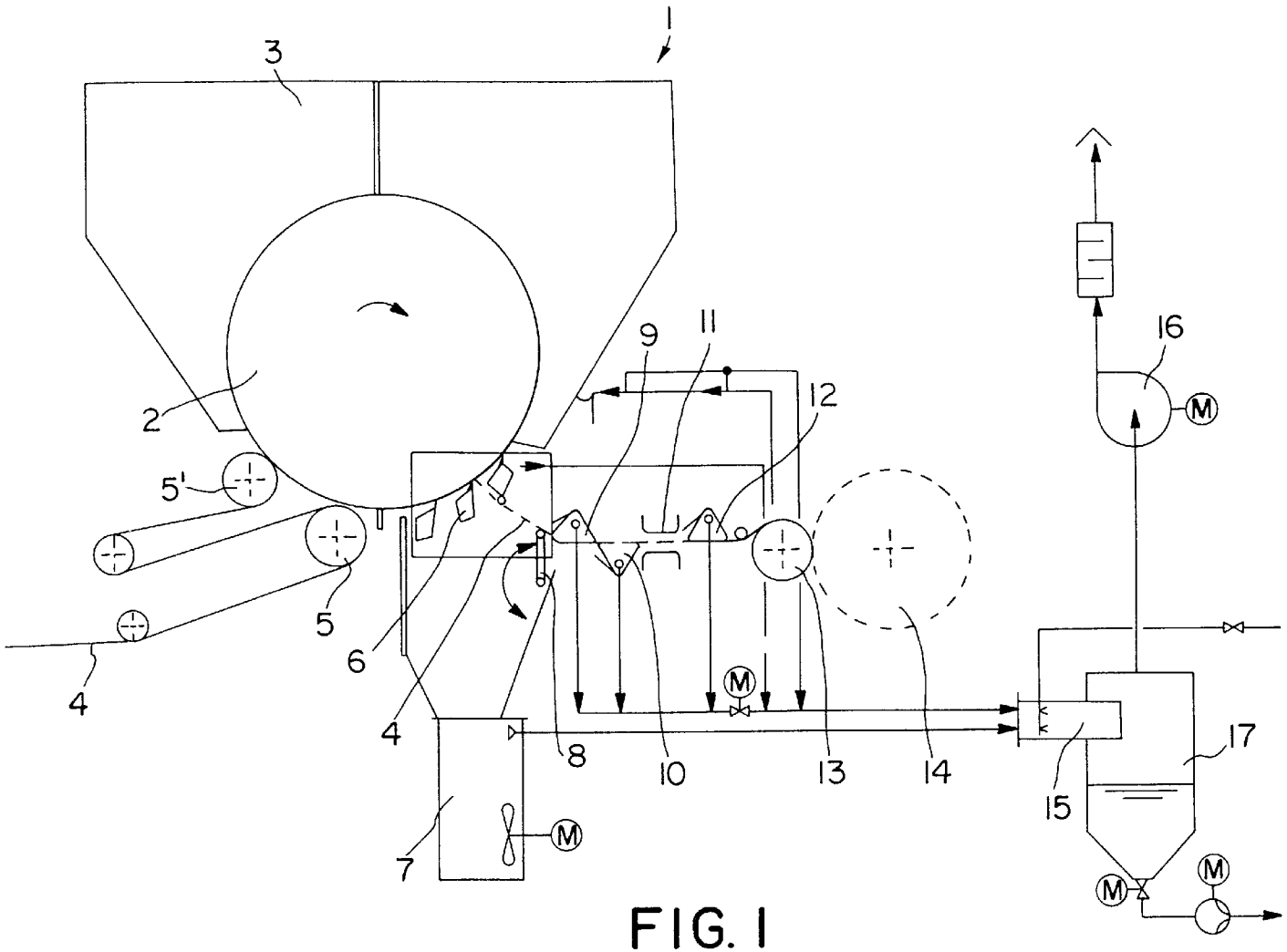
FIG. 1 is a schematic view of a tissue machine having a dust removal system in accordance with the invention.

FIG. 1 contains a diagrammatic view of a dust removal system for a paper web. At the end of the paper production process there is a dryer 1 with a drying cylinder 2 and dryer hood 3, out of is which hot air is blown onto the paper web 4 running round the drying cylinder 2. At the inlet the paper web still runs round press rolls 5, 5'. When the paper web 4 has been dried, it is scraped off the drying cylinder 2 by a doctor 6. A large quantity of dust is produced here and fibers are easily lifted off the surface of the paper. In order to collect and re-use the paper in the event of a sheet break there is a so-called broke chest 7 located beneath the doctor 6. To improve sheet guiding a stabilizer 8 is provided downstream of the doctor 6. Part of the dust-filled air carried along with the web rebounds off the stabilizer and is fed into the broke chest 7, from where this air is extracted. In the event of a sheet break, this stabilizer 8 can be swung downwards so that the paper web can then be fed in again without any difficulty. Adjacent to this stabilizer 8 there is an air separating box 9 on the top side of the paper web which stabilizes the web further and removes the air from the top side of the paper. This is followed by a further separating box 10 on the underside of the paper web, into which the dust-filled air carried along on the underside of the web is deflected. The dynamic impact pressure alone of the air carried along with the web is sufficient to carry this air off and hardly any extraction effect is required. Following the bottom separating box 10 there is usually a traversing measuring device 11 to record the properties of the paper web. A further separation box 12 is provided on the upper side of the web to remove more dust before the web is fed over a work roll 13 and wound onto the reel spool 14. All dust-filled air currents are removed via a dust collector 15, where the dust is removed by injecting water into the collector. The air is extracted by a fan 16, and the dust-filled water drains into a tank 17 and is then discharged as waste water.

Figure 2:
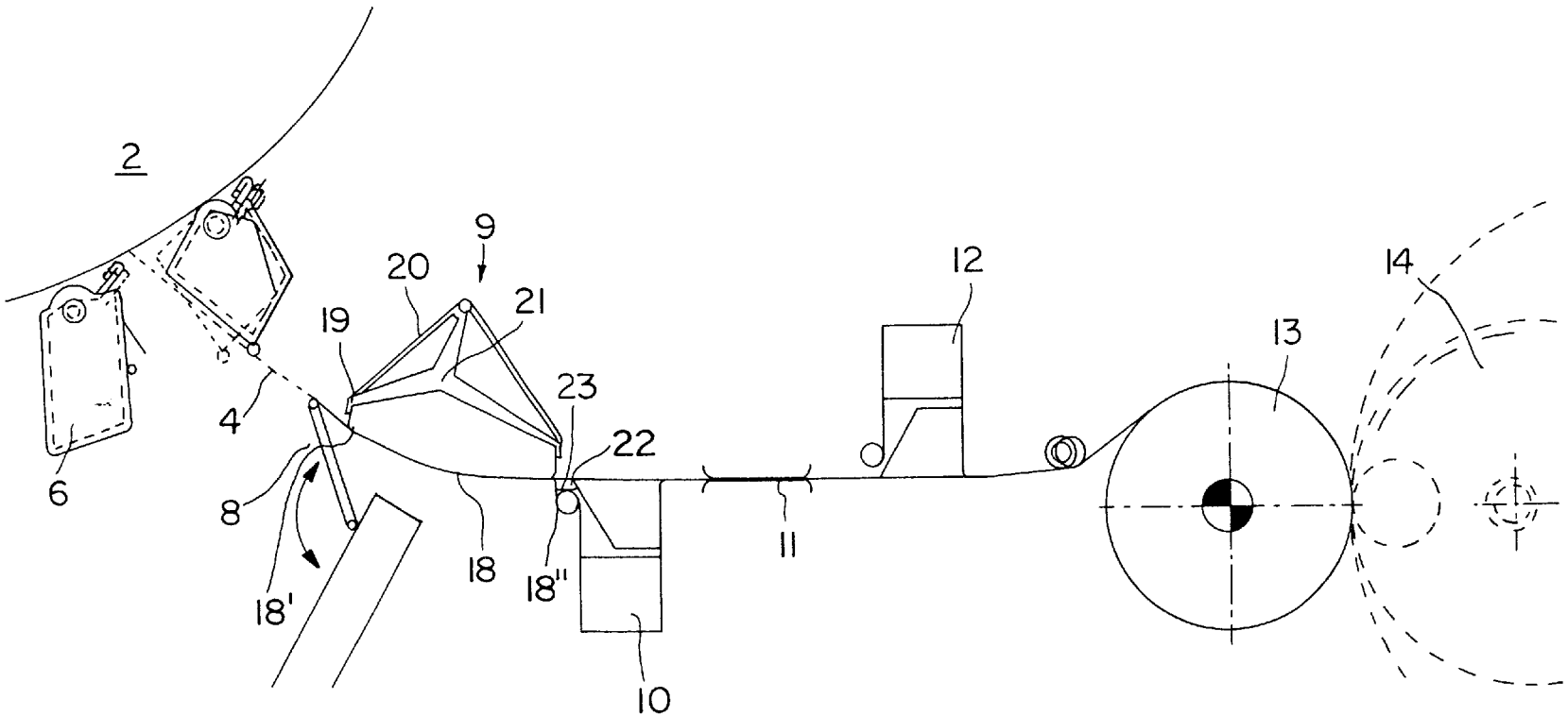
FIG. 2 is an enlarged schematic view of the dust removal system of FIG. 1.

FIG. 2 shows the dust extraction part in detail. The illustration shows the drying cylinder 2 from which the paper web 4 is scraped off by the doctor 6. Part of the dust-filled air is deflected downwards here by the swivelling stabilizer 8 into the broke chest 7. The paper is fed subsequently to the separating box 9, which has a curved guide surface 18 to ensure stable sheet guiding. Here at the inlet 18' the paper web runs at a tangent onto this separating box 9 and leaves the surface of the box again at the outlet 18", also at a tangent. Due to this curved guide surface 18 the required web tension is generated to always guarantee stable sheet guiding. At the inlet 18' the air carried along by the paper web is deflected and directed into a suction slot 19. The wall 20 of the suction slot 19 has a pivoting mounting 29, which allows the suction slot 19 to be adjusted. In order to clean the separating box this wall 20 can be swung straight upwards, thus making the suction duct 21 accessible for cleaning purposes. The inner surfaces of the suction box are smooth and have no sharp edges, corners or other points at which dust can collect. This also facilitates cleaning of the separating box. When the paper web leaves the separating box 19 at the outlet 18", the paper web 4 is fed to a bottom separating box 10. Here the web runs onto the box at a narrow angle, preferably between 1 and 5 degrees, here for example from 1 to 2 degrees, which in turn provides good sheet guiding. The air carried along is directed through a suction slot 22 into the box 10. This suction slot 22 has a deflector plate 23 which can be set to ensure optimum air separation. At the outlet where the paper web leaves the separating box 10 air can be added to prevent vortices forming and avoid any more dust being generated due to underpressure. When the paper web has passed through a traversing measuring device 11, it runs over a further separating box 12 designed in the same way as the bottom separating box 10. After this the web 4 runs over roll 13 and is wound onto the reel spool 14.

Figure 3:
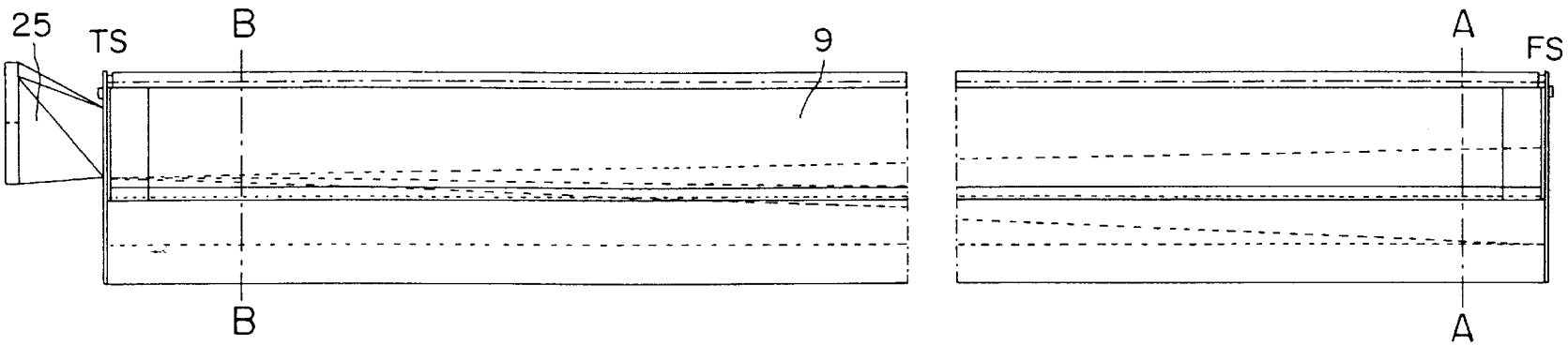
FIG. 3 is an enlarged front view, partly in phantom, of the top separating box of FIG. 2.

FIG. 3 contains a view of the top separating box 9, with the drive side (marked TS) on the left and the so-called tender side (marked FS) on the right of the paper machine. The air is removed from the separation box 9 through a suction pipe 25 on the drive side.

Figure 4A:
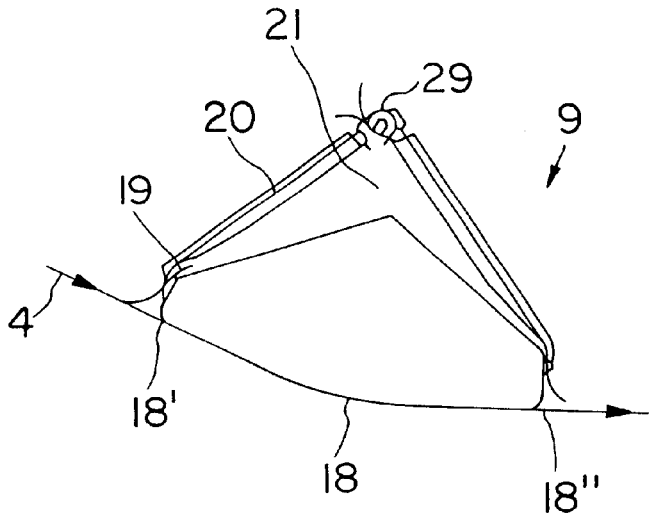
FIGS. 4*a* and 4*b* are cross-section views taken along lines A—A and B—B of FIG. 3, respectively.
Figure 4B:
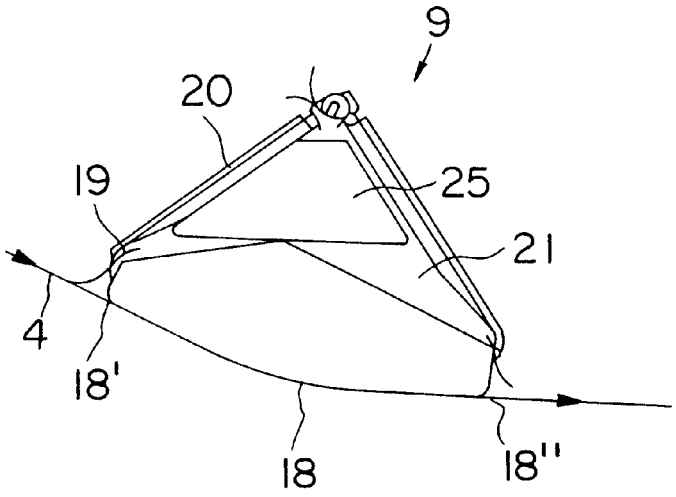

FIGS. 4*a* and 4*b*, respectively, show a cross-section of the separating box 9 near the tender side along the line marked A—A and near the drive side along the line marked B—B. This illustration shows how the cross-section of the suction duct 21 increases from the tender side to the drive side. This has the effect of ensuring that the speeds are more or less constant at all points over the sheet width. As a result there are no local differences in air extraction and the risk of sheet breaks is reduced. FIGS. 4*a* and 4*b* clearly show the route taken by the paper web 4, leading over the guide surface 18 of the separating box 9. At the inlet 18' and outlet 18" the web 4 enters and leaves at a tangent and the configuration of the inlet 18' and outlet 18" ensures that no more dust is generated by deflection of the web. The air from the boundary layer is directed through the suction slot 19 into the collecting duct 21. The wall 20 of the chamber swivels about mounting 29 so that the suction slot 19 can be set and to allow the separating box 9 to be opened for cleaning purposes.

Figure 5:
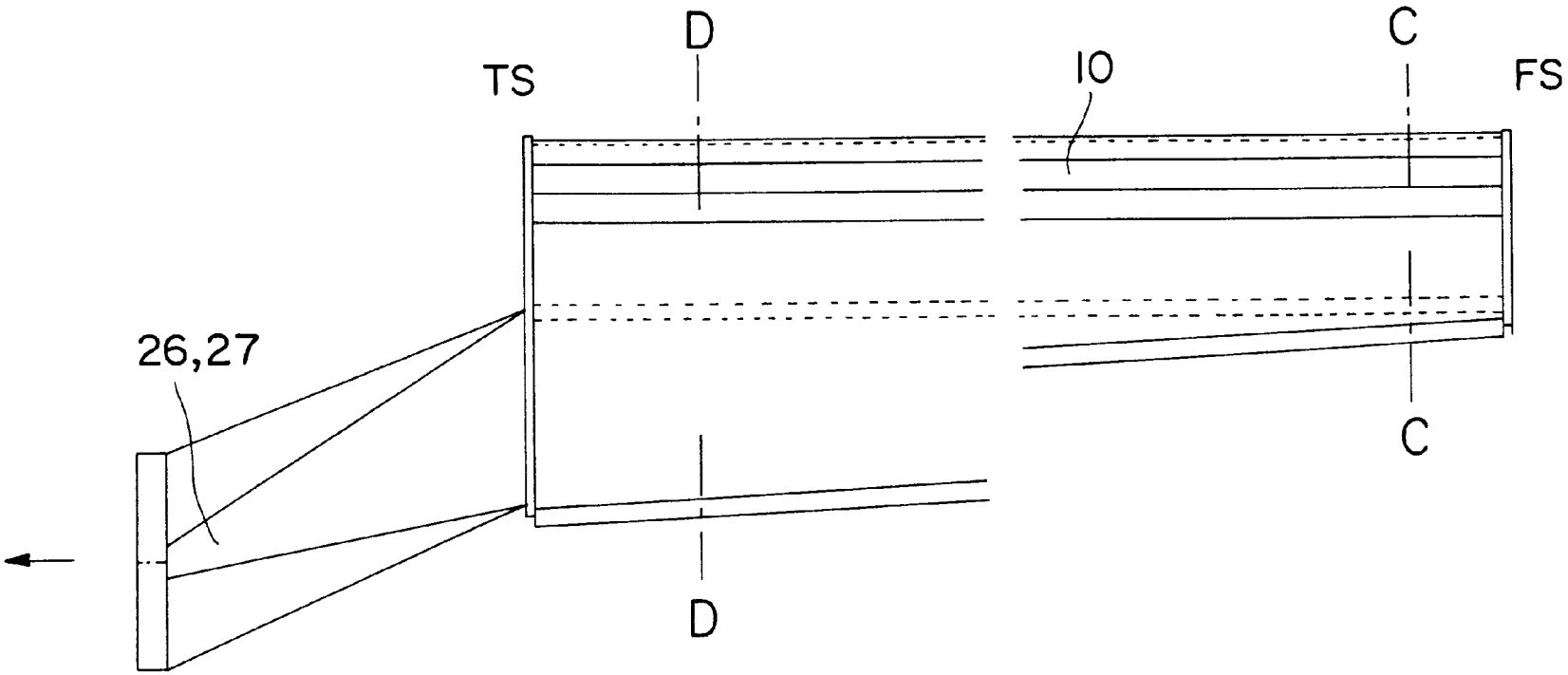
FIG. 5 is an enlarged front view, partly in phantom, of the bottom separating box of FIG. 2.

FIG. 5 contains a view of the bottom separating box 10, again with the drive side of the paper machine on the left and the tender side on the right. Extraction takes place through a duct 26, 27 on the drive side.

Figure 6A:
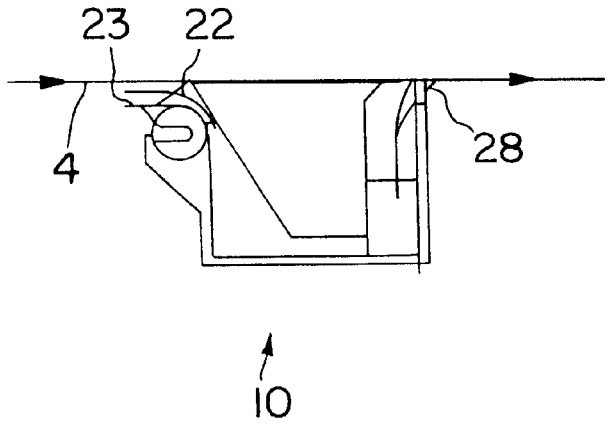
FIGS. 6*a* and 6*b* are cross-section views taken along lines C—C and D—D of FIG. 5, respectively.
Figure 6B:
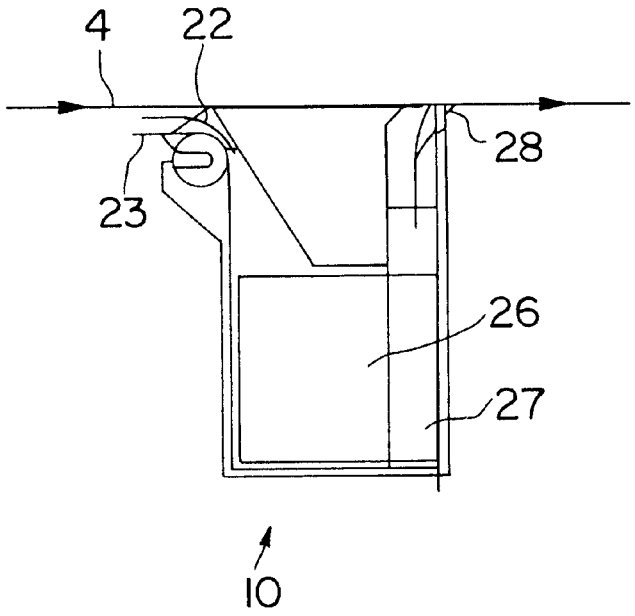

FIG. 6*a* shows a cross-section of the separating box 10 on the tender side along the line marked C—C. This illustration clearly shows how the paper web 4 runs onto the separating box 10 more or less on a level. The air is directed into the separating box 10 by the deflector plate 23. More air can be extracted through an opening 28 when the paper web 4 runs off the separating box 10. FIG. 6*b* contains a cross-sectional view of the separating box 10 on the drive side along the line marked D—D. This figure also shows the ducts 26 and 27.

The invention is not limited to the designs illustrated.

What is claimed is:

1. Device for removing dust from a moving paper web having an upperside and an underside and defining a sheet running direction, a dust-laden air boundary layer running with the paper web, the device comprising a first separating box mounted across the sheet running direction, the first separating box being a stabilizer having a collecting duct, a curved guide surface for the paper web, and apparatus for deflecting the air boundary layer into the collecting duct.

2. Device according to claim 1, wherein the first separating box has a drive side and the collecting duct has a cross-section which widens towards the drive side of the first separating box.

3. Device according to claim 1, wherein the curved guide surface has an inlet side and the first separating box also has a suction slot disposed adjacent the inlet side of the curved guide surface.

4. Device according to claim 3, wherein the suction slot is adjustable.

5. Device according to claim 1, wherein the first separating box is openable along its entire width.

6. Device according to claim 1, further comprising a second separating box disposed adjacent the underside of the paper web, the paper web running onto the second separating box at a very narrow angle.

7. Device according to claim 6, wherein the second separating box has a deflection plate.

8. Device according to claim 7, wherein the deflection plate swivleable.

9. Device according to claim 6, wherein the second separating box is divided into at least two chambers.

10. Device according to claim 1, further comprising a stabilizer disposed upstream of the first separating box, the stabilizer having the effect of spreading the paper web.

11. Device according to claim 10, wherein the stabilizer has a swivelling design.

12. Device according to claim 1, further comprising a doctor area and a funnel-shaped suction hood disposed in the doctor area.

13. Device according to claim 1, further comprising a third separating box disposed adjacent the upperside of the paper web.

* * * * *